US009228401B2

(12) United States Patent
Edwards et al.

(10) Patent No.: US 9,228,401 B2
(45) Date of Patent: Jan. 5, 2016

(54) METHOD OF DETERMINING BOREHOLE CONDITIONS FROM DISTRIBUTED MEASUREMENT DATA

(75) Inventors: Stephen T. Edwards, Hockley, TX (US); Christopher J. Coley, London (GB); Michael L. Edwards, Houston, TX (US); Donald F. Shafer, Austin, TX (US); Mark W. Alberty, Houston, TX (US)

(73) Assignees: BP Corporation North America Inc., Houston, TX (US); BP Exploration Operating Company Limited (GB)

( * ) Notice: Subject to any disclaimer, the term of this patent is extended or adjusted under 35 U.S.C. 154(b) by 1403 days.

(21) Appl. No.: 12/560,158

(22) Filed: Sep. 15, 2009

(65) Prior Publication Data

US 2010/0067329 A1 Mar. 18, 2010

Related U.S. Application Data

(60) Provisional application No. 61/097,128, filed on Sep. 15, 2008.

(51) Int. Cl.

| | |
|---|---|
| ***E21B 47/003*** | (2012.01) |
| ***E21B 47/08*** | (2012.01) |
| ***E21B 21/08*** | (2006.01) |
| ***E21B 33/16*** | (2006.01) |
| ***E21B 47/00*** | (2012.01) |

(52) U.S. Cl.

CPC ..... *E21B 21/08* (2013.01); *E21B 33/16* (2013.01); *E21B 47/0003* (2013.01); *E21B 47/08* (2013.01)

(58) Field of Classification Search

CPC ..... E21B 47/0003; E21B 47/06; E21B 47/08; E21B 21/08

USPC ..... 166/250.01, 250.07, 250.12; 73/151.18–152.22, 152.29–152.33

See application file for complete search history.

(56) References Cited

U.S. PATENT DOCUMENTS

| | | | | |
|---|---|---|---|---|
| 2,718,143 | A * | 9/1955 | Pankratz | 73/152.05 |
| 4,351,037 | A | 9/1982 | Scherbatskoy | |
| 4,703,279 | A | 10/1987 | Chapman et al. | |
| 4,941,951 | A | 7/1990 | Sheppard et al. | |
| 5,006,845 | A * | 4/1991 | Calcar et al. | 367/81 |
| 5,469,736 | A * | 11/1995 | Moake | 73/152.58 |
| 5,591,922 | A * | 1/1997 | Segeral et al. | 73/861.04 |

(Continued)

FOREIGN PATENT DOCUMENTS

EP 1435430 A1 7/2004

OTHER PUBLICATIONS

PCT International Search Report and the Written Opinion dated Mar. 10, 2010 for International Application No. PCT/US2009/056986.

(Continued)

*Primary Examiner* — Elizabeth Gitlin
(74) *Attorney, Agent, or Firm* — John Poliak

(57) ABSTRACT

Borehole conditions can be determined using distributed measurement data. Real time data measurements can be taken from sensors distributed along the length of a drill string to assess various conditions or properties of the borehole. In particular, the distributed data can be used for example, to track the progress of a chemical pill or also track the location of different types of borehole fluids, and also to determine the hole size or volume of the borehole.

5 Claims, 7 Drawing Sheets

(56) References Cited

U.S. PATENT DOCUMENTS

| | | | | |
|---|---|---|---|---|
| 5,900,733 | A * | 5/1999 | Wu et al. | 324/338 |
| 5,959,547 | A | 9/1999 | Tubel et al. | |
| 6,026,912 | A | 2/2000 | King et al. | |
| 6,155,357 | A | 12/2000 | King et al. | |
| 6,176,323 | B1 | 1/2001 | Weirich et al. | |
| 6,192,998 | B1 | 2/2001 | Pinckard | |
| 6,233,498 | B1 | 5/2001 | King et al. | |
| 6,285,026 | B1 * | 9/2001 | Evans et al. | 250/269.4 |
| 6,293,356 | B1 | 9/2001 | King et al. | |
| 6,324,904 | B1 * | 12/2001 | Ishikawa et al. | 73/152.03 |
| 6,382,331 | B1 | 5/2002 | Pinckard | |
| 6,450,259 | B1 * | 9/2002 | Song et al. | 166/255.1 |
| 6,904,981 | B2 | 6/2005 | van Riet | |
| 6,986,396 | B2 | 1/2006 | Hemphill | |
| 7,059,427 | B2 | 6/2006 | Power et al. | |
| 7,139,218 | B2 | 11/2006 | Hall et al. | |
| 7,207,396 | B2 | 4/2007 | Hall et al. | |
| 7,418,865 | B2 * | 9/2008 | Griffiths et al. | 73/597 |
| 7,542,853 | B2 | 6/2009 | Lapierre et al. | |
| 2002/0126021 | A1 | 9/2002 | Vinegar et al. | |
| 2003/0114987 | A1 * | 6/2003 | Edwards et al. | 702/7 |
| 2005/0024231 | A1 | 2/2005 | Fincher et al. | |
| 2005/0145601 | A1 | 7/2005 | Cole et al. | |
| 2005/0194184 | A1 | 9/2005 | Gleitman | |
| 2005/0259512 | A1 * | 11/2005 | Mandal | 367/10 |
| 2006/0033638 | A1 | 2/2006 | Hall et al. | |
| 2006/0254350 | A1 * | 11/2006 | Wraight | 73/152.14 |
| 2007/0278009 | A1 | 12/2007 | Hernandez | |
| 2009/0151939 | A1 * | 6/2009 | Bailey et al. | 166/255.1 |
| 2009/0159334 | A1 | 6/2009 | Alberty | |
| 2009/0166031 | A1 | 7/2009 | Hernandez | |
| 2009/0200079 | A1 | 8/2009 | Zaeper et al. | |

OTHER PUBLICATIONS

Almutairi et al. "Detection of Scale Deposition Using Distributed Temperature Sensing," 2008 SPE International Oilfield Scale Conference, Aberdeen, UK, May 28-29, 2008, SPE 113595, pp. 1-13.

Coles, B. "Computer Modeling of solids loading and its effect on HDD drilling," Halliburton, Houston, Texas, USA.

Cramer et al. "New software moves distributed-temperature sensing data," Shell Global Solutions, Oil & Gas Journal, vol. 106, No. 38, Oct. 13, 2008, (ISSN 0030-1388), pp. 52-54, 56-57.

Hadley et al. "Distributed Temperature Sensor Measures Temperature Resolution in Real Time," 2008 SPE Annual Technical Conference and Exhibition, Denver, Colorado, USA, Sep. 21-24, 2008, SPE 116665, pp. 1-10.

PCT Partial Search Report (Annex to Invitation to Pay Additional Fees) dated Dec. 17, 2009 for International Application No. PCT/US2009/056986.

Wang et al. "Modeling Flow Profile Using Distributed Temperature Sensor (DTS) System," 2008 SPE Intelligent Energy Conference and Exhibition, Amsterdam, The Netherlands, Feb. 25-27, 2008, SPE 111790, pp. 1-11.

PCT International Preliminary Report on Patentability and the Written Opinion of the International Searching Authority, issued for International Application No. PCT/US2009/056986, dated Mar. 15, 2011, 9 pages.

* cited by examiner

METHOD OF DETERMINING BOREHOLE CONDITIONS FROM DISTRIBUTED MEASUREMENT DATA

CROSS-REFERENCE TO RELATED APPLICATIONS

This application claims priority to U.S. Provisional Application No. 61/097,128, filed on Sep. 15, 2008, which is incorporated herein by reference in its entirety for all purposes.

STATEMENT REGARDING FEDERALLY SPONSORED RESEARCH OR DEVELOPMENT

Not applicable

BACKGROUND

1. Field of the Invention

This invention relates generally to the field of drilling. More specifically, the invention relates to a method of analyzing distributed measurements in drilling.

2. Background of the Invention

During drilling operations, measurements of downhole conditions taken in-situ provide valuable information that can be used to optimize drilling practices, enhance operational efficiency and minimize operational risk. These direct measurements can also help to provide a near real time picture of changing trends down hole that can help to allow detection of developing problems in the well. The interest primarily arises from the fact that even minor interruptions in drilling operations can be exorbitantly expensive. Thus, drilling companies have a strong incentive to avoid interruptions of any kind.

Gathering information about down-hole drilling conditions, however, can be a daunting challenge. The down-hole environment is very harsh, especially in terms of temperature, shock, and vibration. Furthermore, many drilling operations are conducted very deep within the earth, e.g., 20,000' 30,000', and the length of the drill string causes significant attenuation in the signal carrying the data to the surface. The difficulties of the down-hole environment also greatly hamper making and maintaining electrical connections down-hole, which impairs the ability to obtain large amounts of data down-hole and transmit it to the surface during drilling operations.

Approaches to these problems are few in terms of assessing adverse downhole drilling conditions. Non-threatening conditions may be recorded, displayed, or analyzed by a computing device as well. In general, data taken from the surface and only limited data taken from the surface and/or the bottom of the borehole is available. The drilling operators must extrapolate the down-hole drilling conditions from this data. Because the borehole might be as deep as 20,000' 30,000', surface data frequently is not particularly helpful in these types of extrapolations. The down-hole data can be more useful than surface data, but its utility is limited by its relatively small amount and the fact that it represents conditions localized at the bottom of the bore. Thus, the down-hole data may be useful in detecting some conditions at the bottom of the borehole but of little use for other conditions along the length of the drill string.

There are significant technical challenges both to gathering data in the downhole environment and also to communicating this data to engineers at the well site or in the office. These problems are exacerbated in very long (extended reach) or very challenging (so called high temperature high pressure) wells. Conventional pressure pulse data transmission suffers both from a significant restriction in the volume of data that can be transmitted to surface, the incremental time taken to transmit and the fact that reliability decreases with increased well depth due to reduction in amplitude of pressure waves as they move up the well.

In drilling operations making use of mud pulse telemetry measurements are taken both down hole and at surface. Surface measurements can be split into instantaneous and lagged while down hole measurements are near instantaneous. Lagged data received at surface refers to measurements made or information inferred from drilling fluid that has been circulated to the surface and can include measurements such as gas concentration, volume of drilled solids carried or mud density. This lagged data takes a significant time to retrieve due to the time required to circulate drilling fluid from the bit to surface and as such is only useful for retrospective analysis. Down hole measurements are more useful but limited in how much of the measured data can be transmitted to surface and also in that there is only a single measurement point usually at the very bottom of the well. In the case of pressure this provides valuable information about the entire fluid column in the annulus but cannot be used to determine the location of any detected anomalies in the annulus we know only that something has happened between surface and the sensor.

One example of an application of downhole monitoring of conditions in down-hole drilling applications are the use of drilling fluids. Drilling fluids (muds) are circulated through the drill string and annulus of the borehole to remove cuttings from the well, lubricate and cool the drill bit, stabilize the well bore walls, prevent undesired influxes by countering formation pore pressure, and the like. The drilling fluid also facilitates removal of cuttings as result of drilling.

Indications that cuttings beds are forming in the well bore can be garnered through increases in torque and drag as well as a reduction in the volume of cuttings seen at surface. Currently however there is no certain method of determining in which regions of the well these beds are forming. The ability to take measurements at multiple points along the well simultaneously and in real time, as well as accelerate data transmission and increase volume of data from BHA conveyed tools that is seen at surface has the potential to increase accuracy and speed of diagnosis of down-hole events in real time.

Accordingly, the use of distributed sensors along the drill string and distributed measurements provides many advantages previously not feasible with existing technologies. However, beyond the basic concept of using distributed measurement data for cuttings loadings, detailed methods for doing so and applications for assessing other borehole conditions have not yet been disclosed with respect to distributed measurements.

Consequently, there is a need for methods of determining borehole conditions using distributed measurement data along the drill string.

BRIEF SUMMARY

Methods of determining borehole conditions using distributed measurement data are disclosed herein. The disclosed methods utilize real time data measurements taken from sensors distributed along the length of a drill string to assess various conditions and/or properties of the borehole. The disclosed methods of processing or using distributed measurement data have not been described before. In particular, the distributed data may be used for example, to track the progress of a chemical pill or also track the location of different types of borehole fluids, and also to determine the hole size or volume of the borehole. Further aspects and features of the disclosed methods are described in more detail below.

In an embodiment, a method of using distributed measurements to determine borehole size comprises drilling a borehole using a drill string. The method further comprises sensing one or more downhole conditions at two or more points distributed along the drill string to collect a distributed measurement dataset. In addition, the method comprises processing the distributed measurement dataset by using the change in the one or more downhole conditions at the two or more points to determine an annular volume between the two or more points and calculate the borehole diameter between the two or more points.

In another embodiment, a method of detecting an out of gauge borehole using distributed measurements comprises drilling a wellbore with a drill string, the wellbore having an annulus pressure and the drill string having an internal drill string pressure. The method additionally comprises sensing one or more downhole conditions at two points distributed along the drill string to collect a distributed measurement dataset. The one or more downhole conditions comprise internal drill string pressure, annulus pressure, or combinations thereof. Furthermore, the method comprises sensing one or more surface conditions to collect a surface dataset, the one or more surface conditions including at least surface mud density. In addition, the method comprises calculating a predicted pressure drop between the two points using the surface mud density. The method further comprises processing the distributed measurement dataset to determine actual pressure drop between the two points and comparing the predicted pressure drop to the actual pressure drop to detect an out-of-gauge borehole.

A method of tracking a chemical pill using distributed measurements comprising drilling a wellbore with a drill string. The method also comprises injecting a chemical pill into the borehole. The method further comprises sensing one or more downhole conditions at a plurality of points distributed along the drill string to collect a distributed measurement dataset. Furthermore, the method comprises comparing the one or more downhole at each point to each other to detect any variance in the one or more downhole conditions. The variance or change in condition is an indication of the location of the chemical pill.

In an embodiment, a system comprises a plurality of sensors distributed along a drill string, which measure one or more downhole conditions at two or more points distributed along the drill string to collect distributed measurement data. The system also comprises an interface coupled to the plurality of sensors for receiving distributed measurement data from the plurality of sensors. In addition, the system comprises a memory resource, input and output functions for presenting and receiving communication signals to and from a human user. The system further comprises one or more central processing units for executing program instructions and program memory, coupled to the central processing unit, for storing a computer program including program instructions that, when executed by the one or more central processing units, cause the computer system to perform a plurality of operations for processing distributed measurement data. The plurality of operations comprises detecting a change in the one or more downhole conditions at the two or more points. Furthermore, the plurality of operations comprises determining a volume of a chemical pill passing between the two or more points based on the change in downhole conditions at the two or more points and calculating an average borehole diameter between the two or more points along the drill string.

The foregoing has outlined rather broadly the features and technical advantages of the invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

NOTATION AND NOMENCLATURE

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct electrical or mechanical connection. Thus, if a first device couples to a second device, that connection may be through a direct connection, or through an indirect connection via other devices and connections.

As used herein, the term "distributed measurement" may refer to the sensing or measurement of one or more parameters from at least two points along the length of a drill string. The terms "distributed measurement dataset," "distributed measurement data," and/or "distributed measurements" may refer to data or measurements collected using a distributed measurement. The distributed measurement dataset may generally include one or more drilling properties as defined below.

As used herein, a "distributed drilling network" is a wired or wireless network of sensors and/or nodes disposed along a drill string.

As used herein, "downhole condition" refers to a localized measurement of a condition at a specific point in the borehole such as without limitation, pressure, temperature, stress, etc.

As used herein, "borehole condition" refers to a calculated or predicted condition or property of the borehole which cannot be directly measured, but may only be assessed by manipulation or processing of distributed measurement data.

As used herein, the term "chemical pill" may refer to a discrete volume or bolus of a fluid injected into the drill string with different properties than the drilling fluid already in the borehole.

DETAILED DESCRIPTION OF THE PREFERRED EMBODIMENTS

Generally, embodiments of a method for determining and/or analyzing borehole conditions in real time involve the sensing and analysis of distributed measurement data. Without limitation, the methods disclosed herein may be applied to the drilling of a wellbore or borehole. In particular, the methods are useful for determining borehole conditions such as without limitation, cuttings loading, hole size, chemical pill location, and the like. Data or measurements may be taken in real time from sensors distributed along a drill string to create a distributed dataset. In addition, data or measurements may be collected of surface properties. These measurements, surface and/or distributed, may be taken during drilling or while the drill string is stationary. The data may be transmitted through the drill string to the surface. The collected data may be processed to determine one or more borehole conditions.

Figure 1:
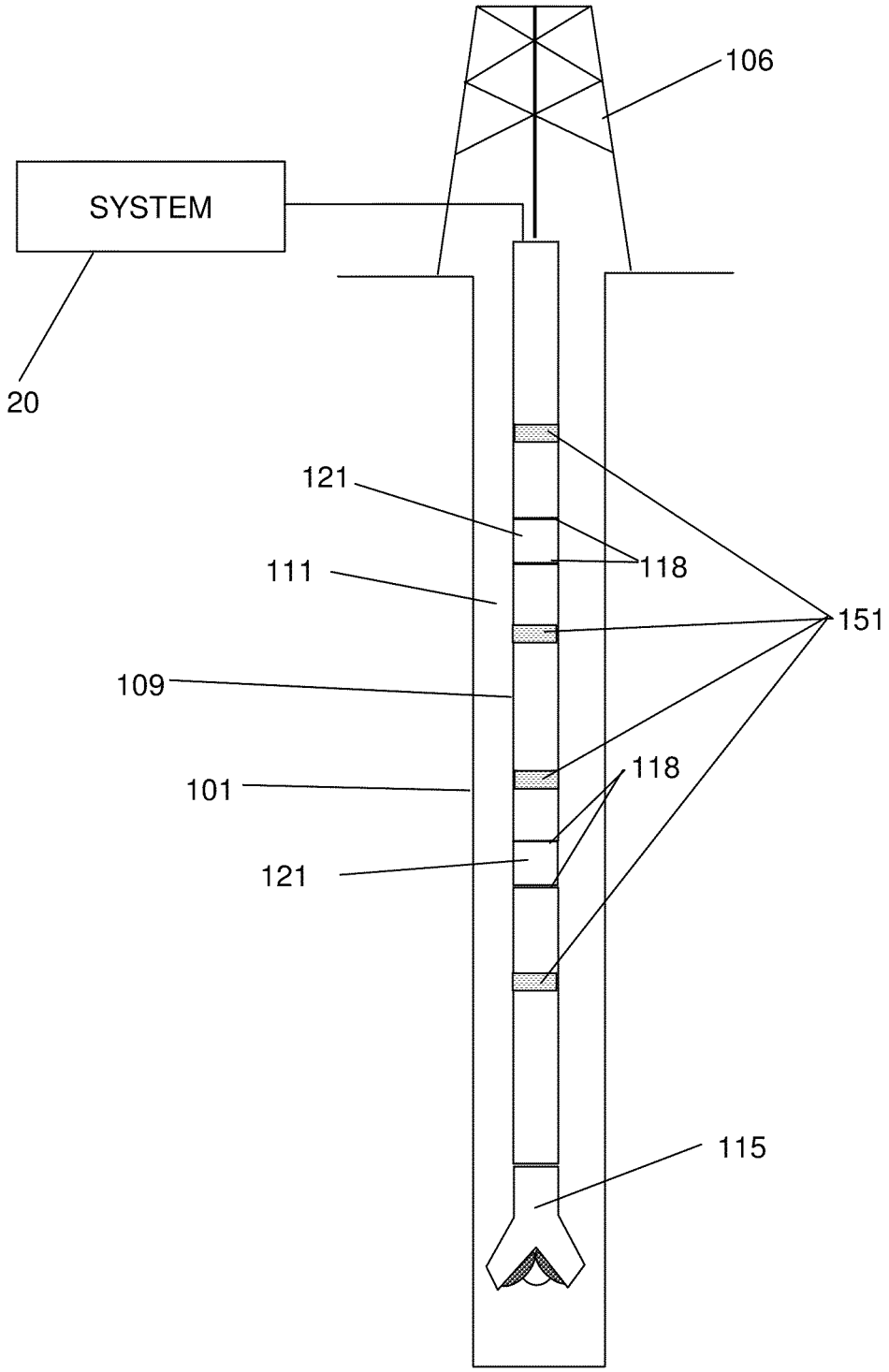
FIG. 1 illustrates an embodiment of a distributed drill network for making distributed measurements that may be used with the disclosed methods.

In general, as shown in FIG. 1, embodiments of the method utilize a drilling system 100 for drilling oilfield boreholes or wellbores utilizing a drill string 109 having a drilling assembly conveyed downhole by a tubing 109 (e.g. a drill string). The disclosed methods may be used with drill strings in vertical wellbores or non-vertical (e.g. horizontal, angled, etc) wellbores. The drilling assembly includes a bottom hole assembly (BHA) and a drill bit. The bottom hole assembly 115 preferably contains commonly used drilling sensors. The drill string 109 also contains a variety of sensors 151 along its length for determining various downhole conditions in the wellbore. Such properties include without limitation, drill string pressure, annulus pressure, drill string temperature, annulus temperature, etc. However, as will be described in more detail below for certain embodiments of the method, more specialized sensors may be employed for sensing specific properties of downhole fluids. Such sensors may detect for example without limitation, radiation, fluorescence, gas content, or combinations thereof. As such, the sensors 151 may include without limitation, pressure sensors, temperature sensors, gas detectors, spectrometers, fluorescence detectors, radiation detectors, rheometers, or combinations thereof.

In other embodiments, sensors 151 may also include sensors for measuring drilling fluid properties such as without limitation density of the drilling fluid, viscosity, flow rate, and temperature of the drilling fluid at two or more downhole locations. Sensors 151 for determining fluid density, viscosity, pH, solid content, fluid clarity, fluid compressibility, and a spectroscopy sensor may also be disposed in the BHA. Data from such sensors may be processed downhole and/or at the surface at a computer system 20. Corrective actions may be taken based upon assessment of the downhole measurements, which may require altering the drilling fluid composition, altering the drilling fluid pump rate or shutting down the operation to clean the wellbore. The drilling system 100 contains one or more models, which may be stored in memory downhole or at the surface. These models are utilized by the downhole processor and a surface computer system 20 to determine desired drilling parameters for continued drilling. The drilling system 100 is dynamic, in that the downhole sensor data is utilized to update models and algorithms in real time during drilling of the wellbore and the updated models are then utilized for continued drilling operations.

Figure 2:
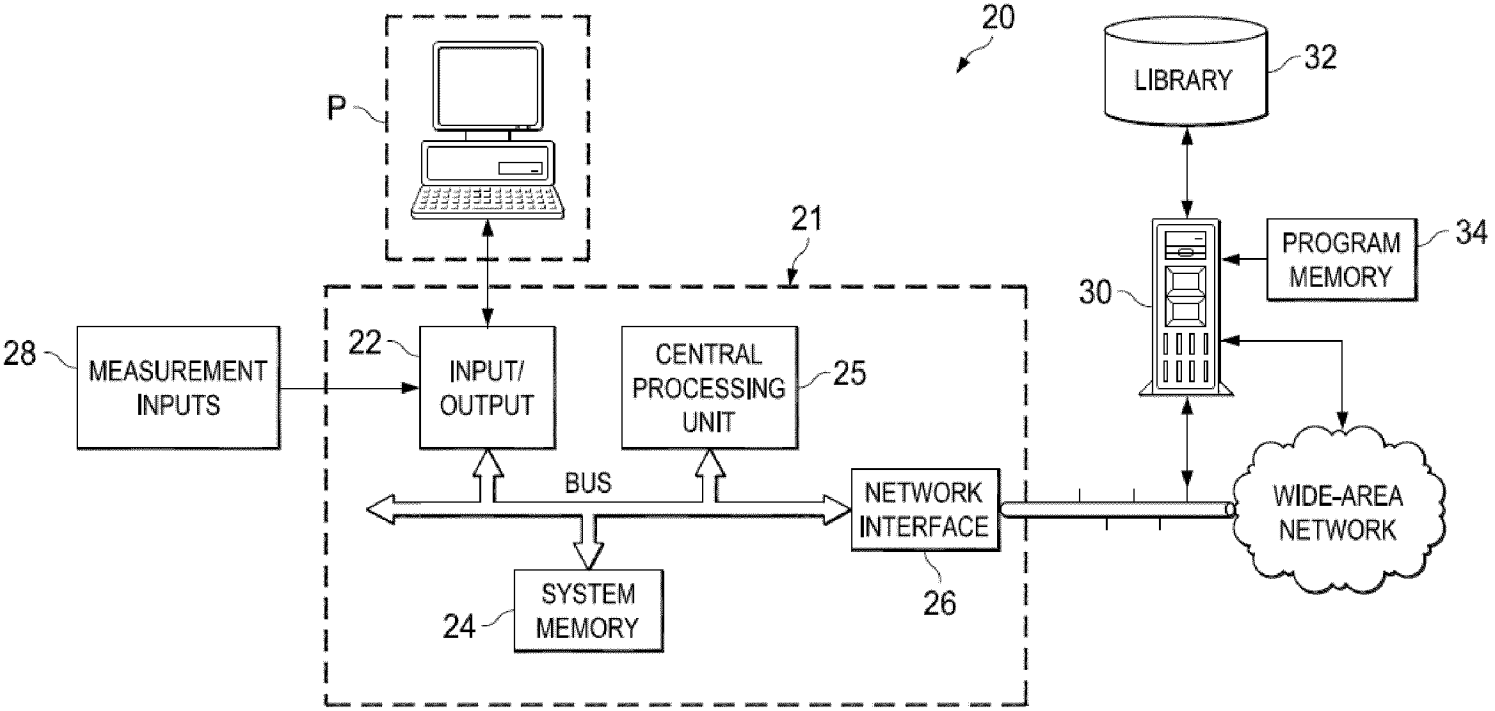
FIG. 2 illustrates a computer system which may used in conjunction with various embodiments of the disclosed methods.

FIG. 2 illustrates, according to an example of an embodiment computer system 20, which performs the operations described in this specification to analyze and process distributed measurement data. In this example, system 20 is as realized by way of a computer system including workstation 21 connected to server 30 by way of a network. Of course, the particular architecture and construction of a computer system useful in connection with this invention can vary widely. For example, system 20 may be realized by a single physical computer, such as a conventional workstation or personal computer, or alternatively by a computer system implemented in a distributed manner over multiple physical computers. Accordingly, the generalized architecture illustrated in FIG. 2 is provided merely by way of example.

As shown in FIG. 2 and as mentioned above, system 20 may include workstation 21 and server 30. Workstation 21 includes central processing unit 25, coupled to system bus BUS. Also coupled to system bus BUS is input/output interface 22, which refers to those interface resources by way of which peripheral functions P (e.g., keyboard, mouse, display, etc.) interface with the other constituents of workstation 21. Central processing unit 25 refers to the data processing capability of workstation 21, and as such may be implemented by one or more CPU cores, co-processing circuitry, and the like. The particular construction and capability of central processing unit 25 is selected according to the application needs of workstation 21, such needs including, at a minimum, the carrying out of the functions described in this specification, and also including such other functions as may be executed by computer system. In the architecture of allocation system 20 according to this example, system memory 24 is coupled to system bus BUS, and provides memory resources of the desired type useful as data memory for storing input data and the results of processing executed by central processing unit 25, as well as program memory for storing the computer instructions to be executed by central processing unit 25 in carrying out those functions. Of course, this memory arrangement is only an example, it being understood that system memory 24 may implement such data memory and program memory in separate physical memory resources, or distributed in whole or in part outside of workstation 21. In addition, as shown in FIG. 2, measurement inputs 28 that are acquired from laboratory or field tests and measurements are input via input/output function 22, and stored in a memory resource accessible to workstation 21, either locally or via network interface 26.

Network interface 26 of workstation 21 is a conventional interface or adapter by way of which workstation 21 accesses network resources on a network. As shown in FIG. 2, the network resources to which workstation 21 has access via network interface 26 includes server 30, which resides on a local area network, or a wide-area network such as an intranet, a virtual private network, or over the Internet, and which is accessible to workstation 21 by way of one of those network arrangements and by corresponding wired or wireless (or both) communication facilities. In this embodiment of the invention, server 30 is a computer system, of a conventional architecture similar, in a general sense, to that of workstation 21, and as such includes one or more central processing units, system buses, and memory resources, network interface functions, and the like. According to this embodiment of the invention, server 30 is coupled to program memory 34, which is a computer-readable medium that stores executable computer program instructions, according to which the operations described in this specification are carried out by allocation system 30. In this embodiment of the invention, these computer program instructions are executed by server 30, for example in the form of a "web-based" application, upon input data communicated from workstation 21, to create output data and results that are communicated to workstation 21 for display or output by peripherals P in a form useful to the human user of workstation 21. In addition, library 32 is also available to server 30 (and perhaps workstation 21 over the local area or wide area network), and stores such archival or reference information as may be useful in allocation system 20. Library 32 may reside on another local area network, or alternatively be accessible via the Internet or some other wide area network. It is contemplated that library 32 may also be accessible to other associated computers in the overall network.

Of course, the particular memory resource or location at which the measurements, library 32, and program memory 34 physically reside can be implemented in various locations accessible to allocation system 20. For example, these data and program instructions may be stored in local memory resources within workstation 21, within server 30, or in network-accessible memory resources to these functions. In addition, each of these data and program memory resources can itself be distributed among multiple locations. It is contemplated that those skilled in the art will be readily able to implement the storage and retrieval of the applicable measurements, models, and other information useful in connection with this embodiment of the invention, in a suitable manner for each particular application.

According to this embodiment, by way of example, system memory 24 and program memory 34 store computer instructions executable by central processing unit 25 and server 30, respectively, to carry out the functions described in this specification, by way of which an estimate of the allocation of gas production among multiple formations can be generated. These computer instructions may be in the form of one or more executable programs, or in the form of source code or higher-level code from which one or more executable programs are derived, assembled, interpreted or compiled. Any one of a number of computer languages or protocols may be used, depending on the manner in which the desired operations are to be carried out. For example, these computer instructions may be written in a conventional high level language, either as a conventional linear computer program or arranged for execution in an object-oriented manner. These instructions may also be embedded within a higher-level application. For example, an executable web-based application can reside at program memory 34, accessible to server 30 and client computer systems such as workstation 21, receive inputs from the client system in the form of a spreadsheet, execute algorithms modules at a web server, and provide output to the client system in some convenient display or printed form. It is contemplated that those skilled in the art having reference to this description will be readily able to realize, without undue experimentation, this embodiment of the invention in a suitable manner for the desired installations. Alternatively, these computer-executable software instructions may be resident elsewhere on the local area network or wide area network, or downloadable from higher-level servers or locations, by way of encoded information on an electromagnetic carrier signal via some network interface or input/output device. The computer-executable software instructions may have originally been stored on a removable or other non-volatile computer-readable storage medium (e.g., a DVD disk, flash memory, or the like), or downloadable as encoded information on an electromagnetic carrier signal, in the form of a software package from which the computer-executable software instructions were installed by allocation system 20 in the conventional manner for software installation.

Figure 3:
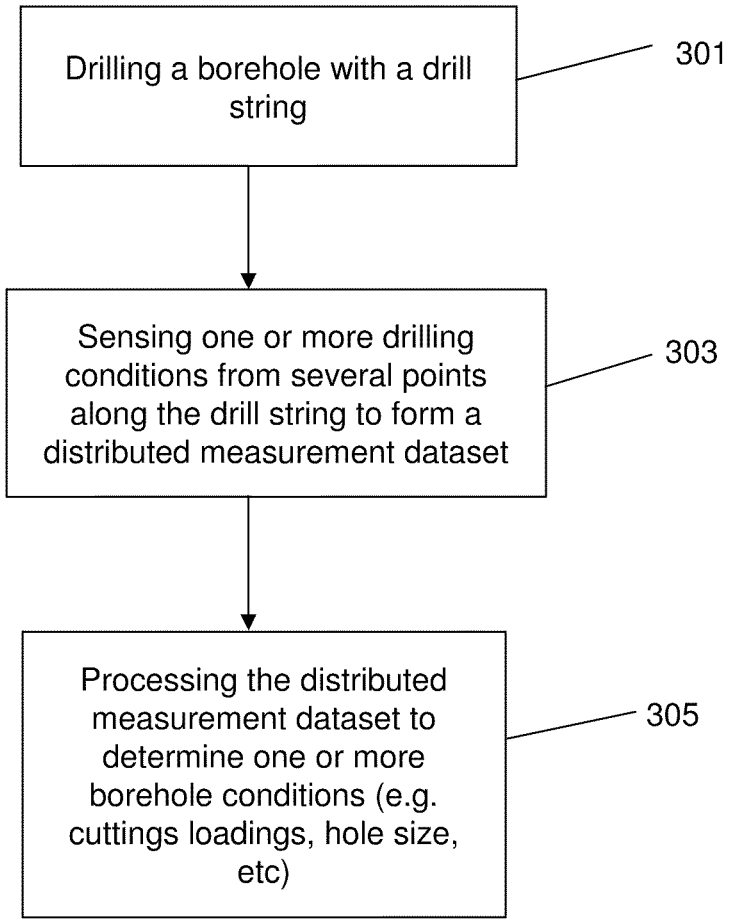
FIG. 3 illustrates a flowchart of a method of determining one or more borehole conditions.

Referring to the flowchart in FIG. 3, in an embodiment, the disclosed methods may comprise drilling a wellbore or borehole in block 201 using a drill string 109. Preferably, drill string 109 incorporates a distributed drilling network. FIG. 1 illustrates an example of a drill string 109 with a distributed drilling network which may be used in conjunction with embodiments of the disclosed methods. Details of the distributed drilling network may be found in U.S. Pat. No. 7,139,218, incorporated herein by reference in its entirety for all purposes. Briefly, FIG. 1 illustrates a drilling system 100 in which a borehole 101 is being drilled in the ground 102 beneath the surface 104 thereof. The drilling operation includes a drilling rig 103 (e.g., a derrick 106, a drill string 109) and a computing apparatus 107. The drill string 109 comprises multiple sections 112 of drill pipe and other downhole tools mated to create joints 118 between the sections 112. A bottom-hole assembly 115, connected to the bottom of the drill string 109, may include a drill bit, sensors, and other down-hole tools. The drill string 109 includes, in the illustrated embodiment, a plurality of network nodes 121 that are inserted at desired intervals along the drill string 109 to perform various functions. For example, the network nodes 121 may function as signal repeaters to regenerate data signals and mitigate signal attenuation resulting from transmission up and down the drill string 109. These nodes 121 may be integrated into an existing section 112 of drill pipe or a downhole tool or stand alone, as in the embodiment of FIG. 1. The distributed measurement data from drill string 109 may be transmitted in real time to computer 107, where the methods disclosed below may be automatically executed by software.

Generally, the methods comprise sensing one or more downhole properties from the sensors distributed along the drill string 109 in block 303. The downhole properties may include any of the properties mentioned above such as without limitation, internal drill string pressure, annulus pressure, drill string temperature, annulus temperature, etc. As used herein, "annulus" 111 refers to the space between drill string 109 and the borehole wall 101. In at least one embodiment, the measurements may be taken after a period of circulation to break up any formed gels. The drill string 109 preferably is not in contact with the bottom of the wellbore during measurement of the drilling properties. Furthermore, drill string 109 may be stationary while taking measurements from the plurality of sensors. However, in some embodiments, drill string 109 may be rotating while data is taken from the sensors.

As described above, one or more sensors 151 may be disposed along the drill string 109 to monitor the properties (i.e. pressure, temperature) of drilling fluids traveling through the annulus. Measurements from the sensors 151 may be transmitted to the surface along a transmission line routed through the drill string. Although the sensors 151 are described here as pressure sensors in other embodiments, the sensors may sense some other rheological property or state of the drilling fluid and/or borehole, such as temperature, viscosity, flow rate, shear rate, depth, or the like, to properly monitor the drilling fluid and/or the borehole. The various measurements from each point along the distributed network constitute the distributed measurement dataset. After sensing different drilling properties or conditions, this distributed measurement dataset may then be processed and manipulated to elucidate different borehole conditions in block 305 of FIG. 3.

Figure 4:
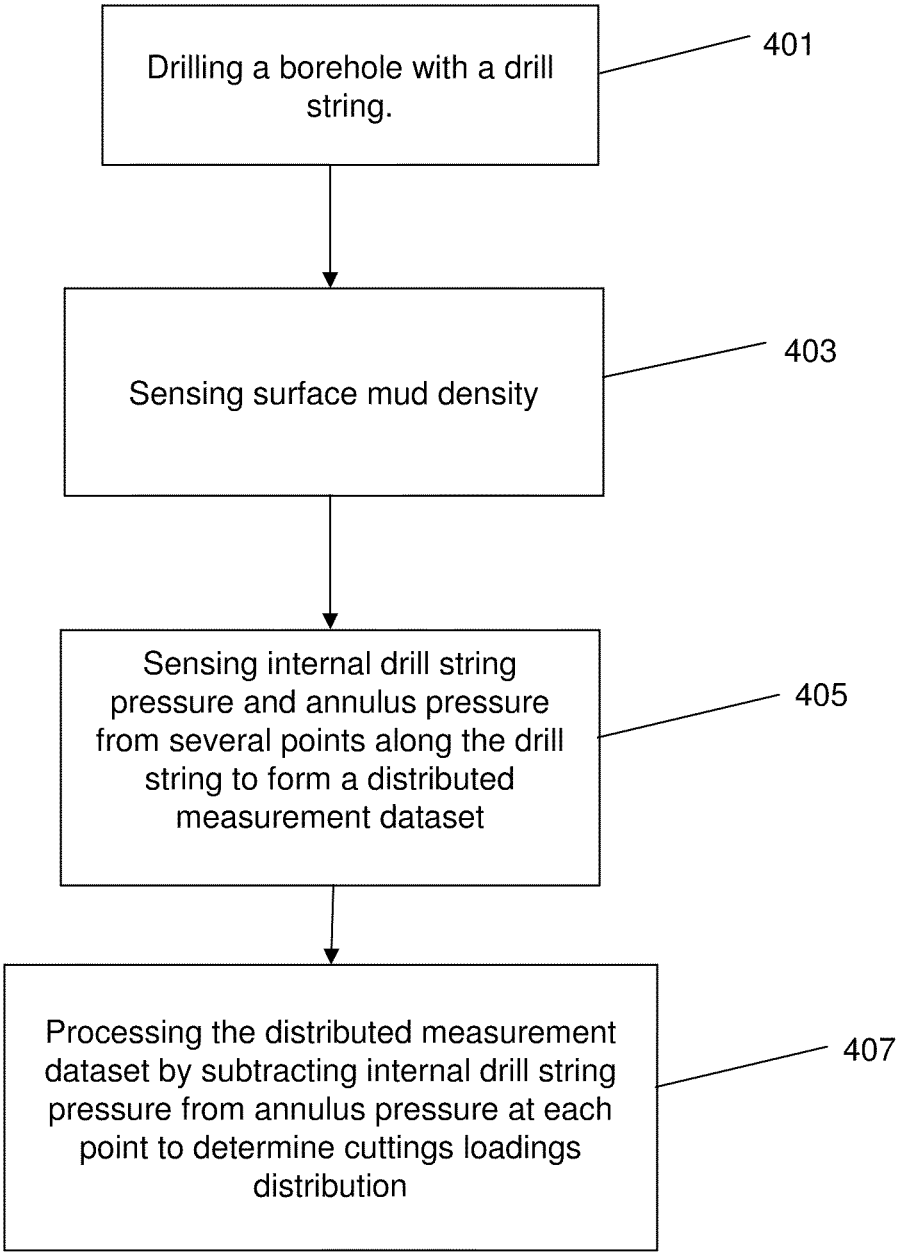
FIG. 4 illustrates a flowchart of an embodiment of a method of determining cuttings loading using distributed measurements.

In view of the above, in one embodiment, the collected pressure data may be used to determine cuttings loading as shown in FIG. 4. As mentioned above, measurements may be made after drill string 109 has ceased to rotate. The surface mud density may also be measure in block 403. Measurements may then be taken of the internal drill string pressure and the annulus pressure at two or more points along the length of the drill string to form a distributed measurement dataset in block 405. The cuttings loading at each point may be calculated by subtracting the annulus pressure from the internal drill string pressure. As a result, a distribution of cuttings loadings along the drill string may be determined from the distributed dataset in block 407. The distribution of cuttings loadings may provide a drill operator insight as to where precisely along the borehole, cuttings may be building up.

According to at least one embodiment, distributed measurement data (e.g. pressure and temperature data from multiple points along a drill string) may be used to validate a hydraulics pressure loss model. For example, the Bingham model and the Power Law model are well known models in the art that are used for predicting pressure loss downhole. Before the advent of the disclosed distributed measurement technology, validation of such models along the entire length of the drill string in real time was not possible. With the collection of distributed measurement data along the length of the drill string, these hydraulic pressure loss models may now be checked or validated for accuracy. It is further envisioned, that other models used in predicting downhole conditions (other than pressure loss) such as models for predicting rheological properties of the drilling fluid could be validated using the distributed measurement data.

In light of the above, an embodiment of a method for validating a hydraulics pressure loss model may involve collecting distributed measurement data while the drill string is rotating to obtain distributed dynamic pressure data from at least two points along the drill string. Distributed measurement data may also be collected while the drill string is stationary to obtain distributed static pressure data from at least two points along the drill string. Once distributed measurement pressure data has been collected, surface mud density may then be measured. Hydraulics pressure loss may then be calculated from the distributed measurement data and compared to predicted pressure loss models (i.e. Power Law, Bingham model, etc.). If any variance or difference is detected between the models and the actual measured downhole pressure, the model parameters may be adjusted to match actual pressure loss so as to more accurately reflect real time conditions.

Figure 5:
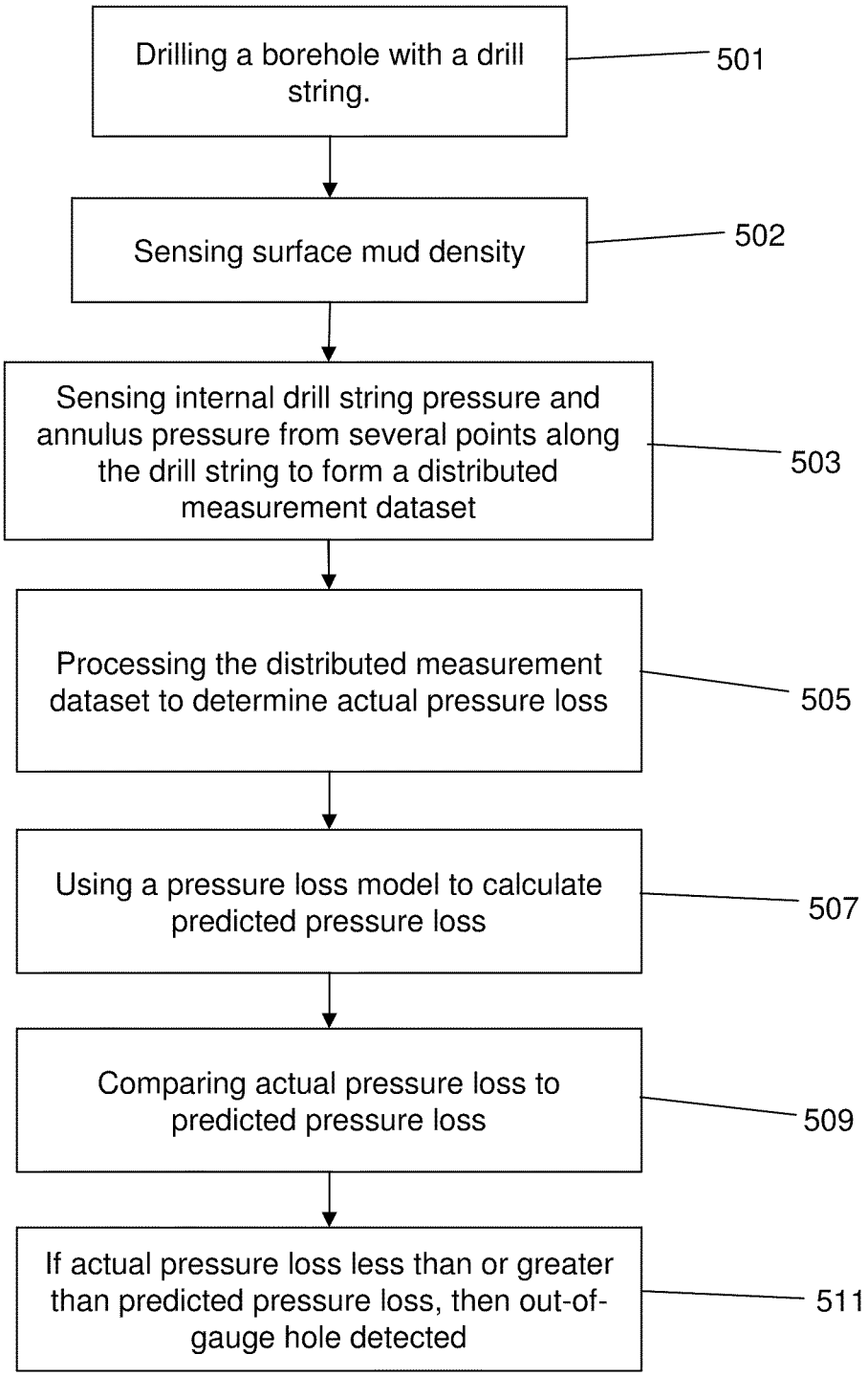
FIG. 5 illustrates a flowchart of an embodiment of a method of detecting an out-of-gauge hole using distributed measurements.

In addition, as shown in FIG. 5, the distributed measurement dataset may be used to detect an out-of-gauge hole. During drilling, it is desirable to maintain a specific diameter hole. Any alteration in the borehole diameter or size may have adverse effects such as damage to the bit. Furthermore, it would be advantageous to be aware of any deviations in the borehole diameter during casing of the well. As such, methods of detecting an out-of-gauge hole in real time would be advantageous. According to one embodiment, a method of detecting an out-of-gauge hole may comprise sensing internal drill string pressure and annular pressure at two or more points distributed along the drill string in block 503. The distributed measurement data collected may then be processed to determine actual pressure drop between the two points in block 505. In addition, the method may comprise calculating a predicted annular pressure drop between the two or more points along the drill string in block 507. Predicted annular pressure drop may be determined by using various models known by those of skill in the art. For example, suitable models may for calculating annular pressure at a specified depth include without limitation, the Bingham model, the Power Law model, and the like.

The measured annular pressure drop may be compared to the predicted annular pressure between the points distributed along the drill string 109 to detect an out-of-gauge hole in block 509. If the measured annular pressure drop is greater or less than the predicted annular pressure drop than an out-of-gauge hole may be detected in block 509. More specifically, if the actual pressure drop is less than the predicted pressure drop, a possible hole constriction may be detected. On the other hand, if the measured annular pressure drop is greater than the predicted annular pressure drop than a possible hole enlargement may be detected. Once an out-of-gauge hole has been detected, a warning may be signaled to a drill operator or a signal may be relayed to automated computer system as described below. If the method is used in conjunction with an expert computer and hardware system as described below, the expert computer and hardware system may make a recommendation to the drill operator on how to correct for the out-of-gauge hole.

Figure 6:
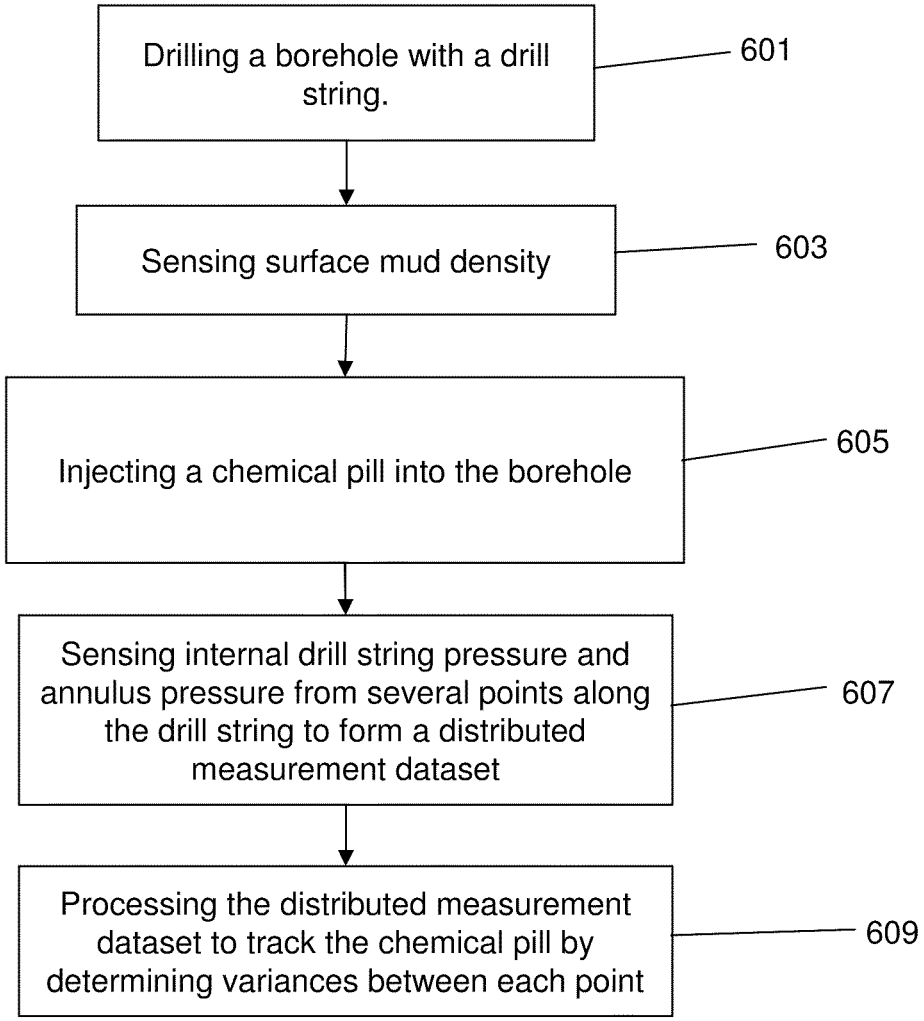
FIG. 6 illustrates a flowchart of an embodiment of a method for tracking a chemical pill.

Referring now to FIG. 6, in an embodiment, collected distributed measurement data (e.g. temperature, pressure) may be used to track a chemical pill. Generally, the fluid used as the chemical pill generally has different physical properties than that of the drilling fluid including without limitation, a different density, a different viscosity, heat capacity, or combinations thereof. Additionally, chemical pills typically are formulated in small volumes (e.g., less than 150 bbl). Chemical pills may be used for various purposes in drilling. For example, during switching of drilling fluid (e.g. drilling mud), a chemical pill is often used to prevent intermingling of the different drilling fluids. In other words, the chemical pill may act like a fluid "spacer." Alternatively, certain chemical pills may be used as borehole cleaners to remove cuttings. As used herein, the term "sweep" may refer to use of pills to remove cuttings beds (and other cuttings that would normally not be brought out of the wellbore by the base drilling fluid system) that are periodically used to prevent buildup to the degree that the cuttings or fines interfere with a drilling apparatus or otherwise with the drilling operation.

Sweeps are commonly applied in vertical as well as in deviated and extended reach drilling applications. The following basic types of sweeps may be used: low viscosity; high viscosity; high density; and tandem sweeps comprised of any two of these three preceding types of sweeps. Depending on the nature of a specific drilling operation, sweeps are used to augment cleaning in intervals ranging from a few hundred feet to over 35,000 feet in length (or depth) and at angles ranging from 0° to about 90° from vertical.

Presently, no methods exist to effectively track the location of the chemical pill. As with the other methods, a borehole may be drilled with a drill string in block 601. The surface mud density may then be measured in block 603. As such, a method for tracking a chemical pill may comprise injecting a chemical pill into the drill string in block 605. The new drilling fluid may then be injected into drill string. Once the new drilling fluid is injected, the chemical pill may be tracked by sensing or monitoring pressure and/or temperature changes along two or more points (e.g. a distributed network of sensors) distributed the length of the drill string 607. Both temperature and/or pressure inside the drill string and within the annulus may be collected to create a distributed dataset for determining the position of the chemical pill. Without being limited by theory, because the chemical pill has different properties than the drilling mud, as the chemical pill passes by each sensor, a corresponding change in temperature and/or pressure may be detected. Furthermore, differences in rheological properties could be sensed along the drill string to track the chemical pill. However, any measurable property of the chemical pill may be sensed. Examples of such properties may include without limitation, density, viscosity, gas content, chemical content, gas concentration, radiation, fluorescence, or combinations thereof. Accordingly, the distributed dataset may be analyzed for differences in pressure, temperature, and/or rheological properties to determine the position of the chemical pill in block 609.

Figure 7:
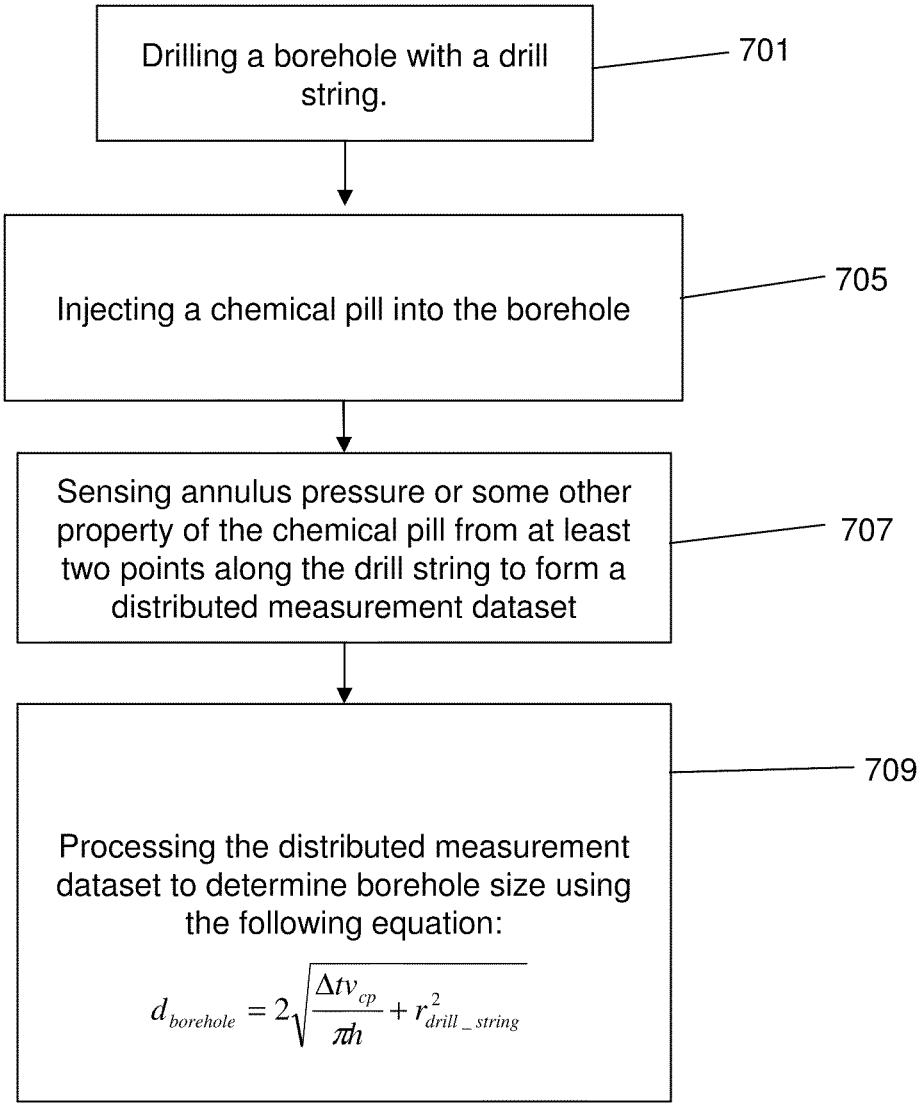
FIG. 7 illustrates a flowchart of an embodiment of a method for determining borehole size using distributed measurements.

In another embodiment, distributed measurement data using a chemical pill may be collected and processed or analyzed to determine borehole diameter as shown in FIG. 7. Determination of borehole diameter and also borehole volume is a valuable measurement for recognizing an overgauge borehole. Oversized or overgauge boreholes may result in improper hole cleaning where cuttings may remain in the well and cause a stuck pipe. In addition, precise borehole diameter measurements may be especially helpful during casing of a well to provide the proper amount of casing cement. Furthermore, an increase in borehole diameter may be an indicator of borehole instability resulting from insufficient drilling mud pressure or improper mud activity.

As described above, referring to FIG. 7, a chemical pill may be injected into the borehole 101 via the drill string at a volumetric flow rate, $v_{cp}$, in block 705. The chemical pill may be injected at any suitable rate. Upon injection, system 20 monitors and records distributed measurements along the length of the borehole 101 from the plurality of sensors 151 positioned at different points along the drill string 109 in block 707. Any suitable measurable downhole condition may be measured such as without limitation, annular pressure, internal drill string pressure, temperature, and the like. Further examples of such conditions are listed below. As the chemical pill passes a first sensor at a first point along the drill string 109, due to the difference in physical properties between the drilling fluid and the chemical pill, a change in pressure will be detected at time, $t_1$. As the chemical pill passes a second sensor at a different point along the drill string 109, a change in pressure will be detected at time, $t_2$. The second sensor may be positioned downhole or uphole to the initial sensor. In block 709, using the difference of $t_2$ and $t_1$, $\Delta t$, as the amount of time it takes for the chemical pill volume to pass the sensors at two or more points along the drill string 109, the annular volume between the two sensors and thus, the diameter of the borehole, $d_{borehole}$, may be calculated by the system 20 using the following equation:

$$d_{borehole} = 2\sqrt{\frac{\Delta t v_{cp}}{\pi h} + r_{drill_string}^2} \quad \text{(Equation 1)}$$

where h=the distance between the two or more points along the drill string 109 as determined by the position of the sensors 151, $v_{cp}$=the volumetric flow rate of the chemical pill, $r_{drill_string}$=the radius of the drill string, and $\Delta t$=the time for the chemical pill to pass from one point to another point as detected by the sensors 151. The chemical pill, thus, may effectively act as a tracer for determining borehole size.

Although, this particular embodiment is described with respect to two sensors and measuring the time between the two sensors, it is contemplated that any number of sensors may be used. Additionally, this determination may be repeated for sensors along the entire length of the borehole providing an operator with borehole diameter profile along its entire length. The distributed sensors may be placed closer together along the drill string to achieve a higher resolution profile of the borehole diameter along its entire length. Furthermore, drill string 109 may be moved up or down to different positions in the borehole 101 to position the sensors 151 to take measurements at different points in the borehole 101. In some cases, sensors 109 may not be positioned in the borehole at different regions of interest in the borehole. The drill string 109 may be repeatedly moved and measurements taken to determine borehole diameter for different regions of the borehole 101. In this way, further precision is possible in determining borehole diameter over the entire length of the borehole 101.

In an alternative embodiment, specialized sensors may be utilized which measure properties such as without limitation, the presence of gas (i.e. gas content or gas concentration), radiation, fluorescence, and the like. Any suitable sensors known in the art may be used. Examples of such sensors or detectors may include without limitation, gamma detectors, radiation detectors, gas detectors, spectrometers, rheometers, or combinations thereof. In such embodiments, the chemical pill may have certain properties specific to the sensors distributed along the drill string. For example, in a distributed measurement system having a plurality of gas detectors along the drill string, the chemical pill may be impregnated with a gas. In other embodiments, the chemical pill may be irradiated or may be composed of fluorescent materials. It is emphasized that any measurable downhole condition may be detected as long as it is distinguishable or provides contrast to the ambient downhole conditions. Nevertheless, the same methodology for determining borehole size described above for annular pressure may be used in conjunction with other measurements such as without limitation, gas detection, radiation, and the like. In addition, it is contemplated that these specialized measurements (e.g. radiation, fluorescence, gas detection, etc) may also be used to track a chemical pill in the method shown in FIG. 6.

Although the methods described above involve the use of a chemical pill, other embodiments of the method may not use chemical pills. So long as a discrete or measurable volume of a drilling fluid has some distinguishable and detectable property compared to the rest of the drilling fluids which may be detected by the distributed sensors 151, the disclosed methods remain usable. As such, instead of using a chemical pill, the method may merely comprise detecting an influx of gas from the formation and measuring the time for the influx of gas to pass two or more points along the drill string 109. In such embodiments, Equation 1 may be used except $\Delta t$ would be the amount of time such discrete volume of the drilling fluid would pass between the sensors, as detected by the sensors and $v_{cp}$ would be the volumetric flow rate of the drilling fluid instead of just the chemical pill.

Embodiments of the disclosed methods may be used in conjunction with an expert computer hardware and software system, implemented and operating on multiple levels, to derive and apply specific behavioral tools at a drilling site from a common knowledge base including information from multiple drilling sites, production fields, drilling equipment, and drilling environments. At the highest level, a knowledge base is developed from attributes and measurements of prior and current wells (including distributed measurements), seismic information regarding the subsurface of the production fields into which prior and current wells have been or are being drilled, and the like. In this highest level, an inference engine drives rules and heuristics based on the knowledge base and on current data; an interface to human expert drilling administrators is provided for verification of these rules and heuristics. These rules and heuristics pertain to drilling states and drilling operations, as well as recommendations for the driller, and also include a trendology that manages incoming data based on the quality of that data, such management including the amount of processing and filtering to be applied to such data, as well as the reliability level of the data and of calculations therefrom. The expert computer hardware and software system is described in more detail in U.S. application Ser. No. 12/261,198, incorporated herein by reference in its entirety for all purposes.

The methods of using distributed measurement data described herein may provide enhanced accuracy and expertise in providing advice and/or recommendations to a drilling operator when used in conjunction with embodiments of the expert computer system and software system described above. It is envisioned that all of the above disclosed methods may be implemented as software, which may be run on a computer.

While the embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

The discussion of a reference is not an admission that it is prior art to the present invention, especially any reference that may have a publication date after the priority date of this application. The disclosures of all patents, patent applications, and publications cited herein are hereby incorporated herein by reference in their entirety, to the extent that they provide exemplary, procedural, or other details supplementary to those set forth herein.

What is claimed is:

1. A system, comprising: a plurality of sensors distributed along a drill string, which measure one or more downhole conditions at two or more points distributed along the drill string to collect distributed measurement data, the one or more downhole conditions comprising at least one of pressure or temperature;

an interface coupled to the plurality of sensors for receiving distributed measurement data from the plurality of sensors;

a memory resource;

input and output functions for presenting and receiving communication signals to and from a human user;

one or more central processing units for executing program instructions; and program memory, coupled to the central processing unit, for storing a computer program including program instructions that, when executed by the one or more central processing units, cause the computer system to perform a plurality of operations for processing distributed measurement data, the plurality of operations comprising:

(a) detecting a change in the one or more downhole conditions at the two or more points, wherein the change in the one or more downhole conditions comprises a change in pressure;

(b) determining a volume of a chemical pill passing between the two or more points based on the change in downhole conditions at the two or more points; and (c) calculating an average borehole diameter between the two or more points along the drill string.

2. The system of claim 1 wherein the plurality of operations further comprises calculating an average borehole diameter between the two or more points using the following equation:

$$d_{borehole} = 2\sqrt{\frac{\Delta t v_{cp}}{\pi h} + r_{drill_string}^2}$$

where h=the distance between the two or more points, $v_{cp}$=the volumetric flow rate of the chemical pill, $r_{drill_string}$=the radius of the drill string, and Δt=the time for the chemical pill to pass between the two or more points.

3. The system of claim 1 wherein the plurality of sensors comprises pressure sensors, temperature sensors, gas detectors, spectrometers, fluorescence detectors, radiation detectors, rheometers, or combinations thereof.

4. The system of claim 1 wherein the plurality of operations further comprises repeating (a) through (c) for different segments along the drill string to produce a cross-sectional profile of the average borehole diameter in a well.

5. The system of claim 1 wherein the plurality of operations further comprises comparing the one or more downhole conditions at each point to each other to detect any variance in the one or more downhole conditions, wherein the variance is an indication of the location of the chemical pill.

* * * * *